US005163387A

United States Patent [19]

Lee

[11] Patent Number: 5,163,387

[45] Date of Patent: Nov. 17, 1992

[54] DEVICE FOR ATTENUATING STANDING WAVES IN AN INDUCTION INTAKE SYSTEM

[75] Inventor: Carlos Lee, Chatham, Canada

[73] Assignee: Siemens Automotive Limited, Chatham, Canada

[21] Appl. No.: 772,739

[22] Filed: Oct. 7, 1991

[51] Int. Cl.[5] ..... F02M 35/00

[52] U.S. Cl. ..... 123/52 M; 181/229

[58] Field of Search ..... 123/52 M, 52 MV, 52 MB, 123/52 MC; 181/206, 229

[56] References Cited

U.S. PATENT DOCUMENTS 4,934,343 6/1990 Lee ..... 123/52 M

FOREIGN PATENT DOCUMENTS 0123139 10/1984 European Pat. Off. ..... 123/52 M
3219699 12/1983 Fed. Rep. of Germany ... 123/52 M
58-57055 4/1983 Japan ..... 123/52 M
2132692 7/1984 United Kingdom ..... 123/52 M
2160264 12/1985 United Kingdom ..... 123/52 M

*Primary Examiner*—David A. Okonsky
*Attorney, Agent, or Firm*—George L. Boller; Russel C. Wells

[57] ABSTRACT

The device has a generally cylindrical chamber with a fluid inlet in an end wall and a fluid outlet in the sidewall. Fluid introduced into the device via the inlet passes through a venturi before being discharged into the interior of the chamber. A curved baffle confronts the venturi's outlet and directs fluid along an arc toward the device's outlet.

16 Claims, 1 Drawing Sheet

DEVICE FOR ATTENUATING STANDING WAVES IN AN INDUCTION INTAKE SYSTEM

FIELD OF THE INVENTION

This invention relates to an in-line device for an induction intake system of a machine to attenuate standing waves created in the system by the operation of the machine. The device is useful in attenuating intake noise rumble in an induction intake system of a reciprocating internal combustion engine or compressor.

BACKGROUND AND SUMMARY OF THE INVENTION

The induction intake system of a machine like a reciprocating internal combustion engine or compressor communicates the working chamber space of the machine to a source of working fluid such as air. As the machine operates, it creates a partial vacuum that draws fluid through the system and into the machine. The induction intake system acts like a two-way street so that as fluid is being conveyed toward the machine, noise created by the machine's operation is transmitted in the opposite direction. This noise is often deemed sufficiently objectionable that it is required to be attenuated. For that purpose it is known to insert passive noise attenuation devices into the intake system, and examples of such devices are found in commonly assigned patents of the same inventor, U.S. Pat. No. 4,934,343 and U.S. Pat. No. 4,936,413.

The present invention relates to a new and unique device which can be inserted in-line into an induction intake system of a machine, such as those mentioned, for attenuating standing wave noise that the machine transmits through the intake system. Like the devices of the referenced patents, the device of the present invention is entirely passive and imposes no significant restriction on the fluid flow through the intake system to the machine.

Further features, advantages, and benefits of the invention will become apparent from the following detailed description, the appended claims, and the accompanying drawings which disclose a presently preferred embodiment of the invention according to the best mode contemplated at the present time in carrying out the invention.

DESCRIPTION OF THE PREFERRED EMOBIDMENT

Figure 1:
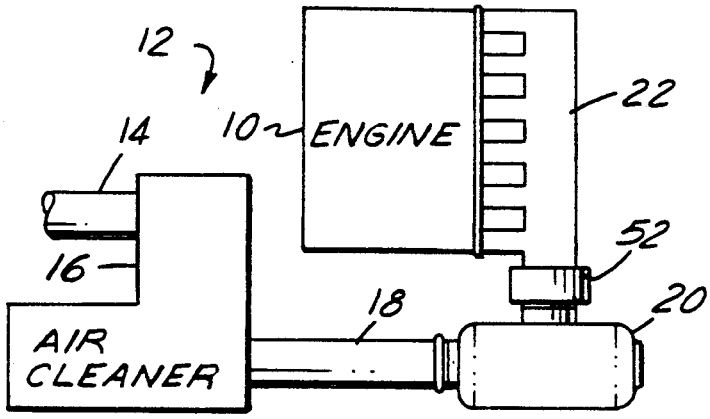
FIG. 1 is a schematic representation of an internal combustion engine that has an air induction intake system including the device of the present invention.
Figure 2:
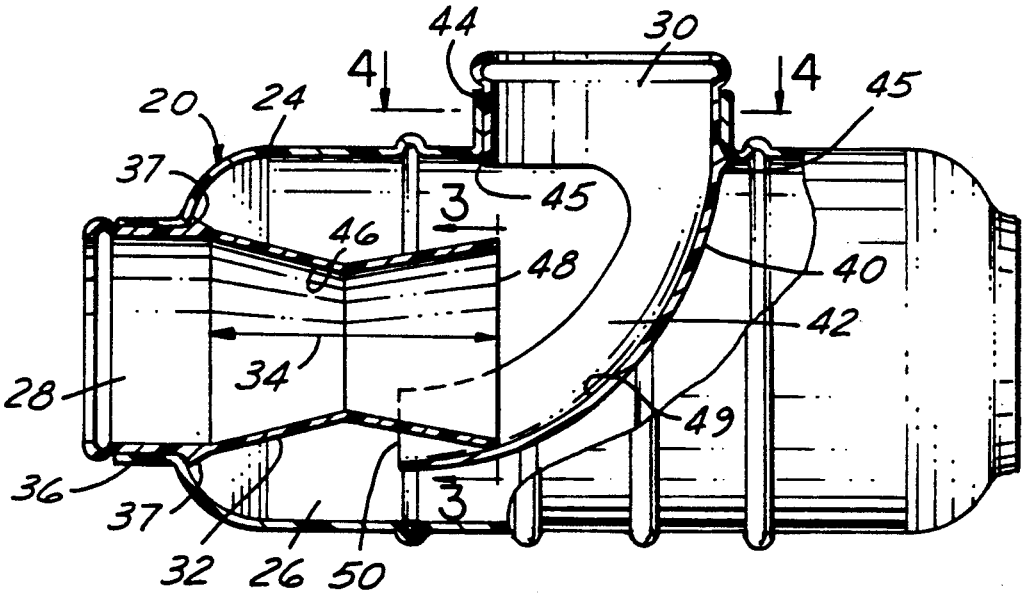
FIG. 2 is a longitudinal view with portions sectioned away for illustrative purposes showing a presently preferred embodiment of the device.
Figure 3:
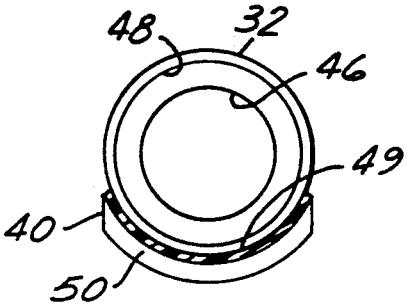
FIG. 3 is a transverse cross sectional view taken in the direction of arrows 3—3 in FIG. 2.
Figure 4:
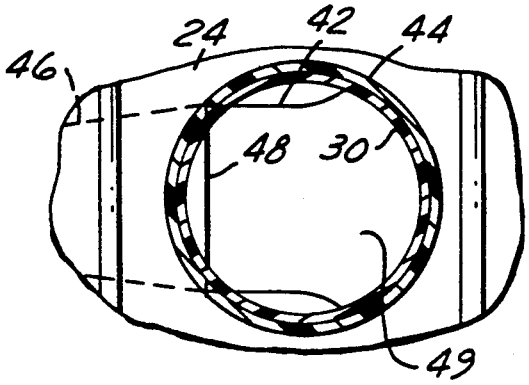
FIG. 4 is a fragmentary cross sectional view taken in the direction of arrows 4—4 in FIG. 2.

FIG. 1 shows an internal combustion engine 10 having an air intake system 12 through which the engine inducts combustion air into its cylinders for combustion with fuel to create in each cylinder a combustible mixture that is compressed and combusted to power the engine. The system comprises in order in the direction of induction flow: an inlet passage 14; an air cleaner assembly 16; a connecting Details of device 20 are disclosed with reference to FIGS. 2–4. Device 20 comprises a generally cylindrical chamber 24 that encloses a chamber space 26. It also has an inlet tube 28 and an outlet tube 30 via which the device connects in-line in the induction intake system. Each tube is circular in transverse cross section, and they are disposed in respective end wall and sidewall portions of chamber 24 so that their axes are at an approximate right angle to each other.

Inlet tube 28 is a portion of a part 32 the remainder of which is a venturi section 34 disposed coaxially downstream of the inlet tube within chamber space 26. Part 32 is assembled to chamber 24 by insertion, venturi end first, through a circular tubular-walled opening 36 that is integrally formed with chamber 24 in the one axial end wall portion of the chamber until integral catches 37 formed at spaced apart locations around the outside of part 32 snap onto the inner edge of the tubular-walled opening.

Outlet tube 30 is a portion of a part 40, the remainder of which is a curved baffle 42 disposed in chamber space 26 upstream of the outlet tube. Part 40 is joined to chamber 24 in similar manner to that of part 32, namely by insertion, baffle end first, through a circular tubular-walled opening 44 integrally formed in the sidewall of chamber 24 until integral catches 45 formed at spaced apart locations around the outside of part 40 snap onto the inner edge of the tubular-walled opening.

Venturi section 34 comprises a single venturi 46 that has a circular outlet 48 via which flow that has passed through part 32 discharges into chamber space 26. Curved baffle 42 confronts outlet 48 within chamber space 26. Curved baffle 42 has a concave surface 49 which confronts outlet 48. In transverse cross section as appears in FIG. 3, concave surface 49 is substantially circularly contoured and has an extent in the circular sense which is slightly less than a semi-circle. The end portion 50 of curved baffle 42 which is opposite outlet tube 30 axially overlaps the outside of venturi section 34 around outlet 48. Surface 49 has edge contact with the outside of the venturi at outlet 48.

From its end portion 50, curved baffle 42 curves lengthwise along an arc toward hole 44. This arc has substantially a circular curvature in this instance. As it approaches the inner edge of tubular-walled opening 44, curved baffle 42 merges into outlet tube 30. Because of the nature of the fit between the parts as shown in the drawing Figs., it is preferable to assemble part 40 to chamber 24 before part 32.

The three parts 24, 32, and 40 can be advantageously fabricated by conventional plastic fabrication procedures, part 24 by blow molding, and parts 32 and 40 by injection molding. A cylindrical chamber 24 of approximately two liter size has been found suitable for attenuating the large standing waves associated with rumble in an internal combustion engine. Chamber 24 is disposed close to the intake manifold, downstream of the throttle body, and suitable conduits and/or adapters, such as 18 and 52, can be fitted over the inlet and outlet tubes 28 and 30 to complete the in-line insertion of the device into the system.

Chamber space 26 prevents the formation of large standing waves. It also functions as an expansion chamber for breaking up, absorbing, and/or dissipating acoustical energy. Venturi 46 enhances the performance of the expansion chamber by increasing the "m-ratio" (the ratio between the diameter of chamber 24 and the diameter of inlet tube 28, as measured at the narrowest point in the venturi. The larger the "m-ratio", the better the performance of the expansion chamber 24. The venturi reduces restriction by progressively increasing the diameter of the inlet tube in contrast to a sudden expansion associated with a straight pipe expansion inlet.

While a representative embodiment and representative uses have been illustrated and described, it should be appreciated that the device can be embodied in other equivalent ways and employed in other uses where it is desired to attenuate large standing waves. In any particular embodiment, specific sizes, shapes, proportions, and the like can be determined either empirically by experimentation or analytically by using conventional principles of physics and acoustical engineering.

What is claimed is:

1. A device for in-line insertion into a fluid-carrying induction intake system to attenuate standing wave noise in such a system without imposing unacceptable restriction to fluid flow through the system comprising a walled chamber enclosing a chamber space, a tubular inlet and a tubular outlet via which the chamber can be connected into such a system, a venturi section that is disposed on said chamber and serves to convey fluid from said inlet into said chamber space, and a baffle section that is disposed on said chamber and serves to direct fluid from said chamber space to said outlet, wherein said venturi section terminates in a discharge opening that is disposed within said chamber space to discharge into said chamber space fluid that has entered said device through said inlet, and said baffle section comprises a surface which is concave in transverse cross section, which confronts said discharge opening, and which extends from its confrontation with said discharge opening lengthwise along an arc to said outlet to direct fluid toward said outlet.

2. A device as set forth in claim 1 in which said inlet is disposed in an axial end wall portion of the wall of said chamber and said outlet is disposed in a sidewall portion of the wall of said chamber.

3. A device as set forth in claim 1 in which said inlet comprises a circular transverse cross section, said outlet comprises a circular transverse cross section, and the axis of said outlet is disposed at an approximate right angle to the axis of said inlet.

4. A device as set forth in claim 1 in which said inlet is disposed in an axial end wall portion of the wall of said chamber, said outlet is disposed in a sidewall portion of the wall of said chamber, said inlet comprises a circular transverse cross section, said outlet comprises a circular transverse cross section, and the axis of said outlet is disposed at an approximate right angle to the axis of said inlet.

5. A device as set forth in claim 1 in which said surface axially overlaps a portion of said venturi section that is immediately contiguous said discharge opening.

6. A device as set forth in claim 5 in which said discharge opening is circular and said surface as viewed in transverse cross section has an arcuate extent slightly less than that of a semi-circle as measured about said discharge opening.

7. A device as set forth in claim 1 in which said baffle section further includes an integral tubular section which fits closely within and has a snap-on attachment with a tubular-walled opening extending through the wall of said chamber for disposing said baffle section on said chamber, said tubular section forming said outlet.

8. A device as set forth in claim 1 in which said venturi section includes an integral tubular section which fits closely within and has a snap-on attachment with a tubular-walled opening extending through the wall of said chamber for disposing said venturi section on said chamber, said tubular section forming said inlet.

9. An I.C. engine induction air intake system comprising a device to attenuate standing wave noise in said system without imposing unacceptable restriction to fluid flow through the system characterized by the improvement wherein said device comprises a walled chamber enclosing a chamber space and having a tubular inlet and a tubular outlet via which the chamber is connected into such a system, a venturi section that serves to convey fluid from said inlet into said chamber space, and a baffle section that serves to direct fluid from said chamber space to said outlet, wherein said venturi section terminates in a discharge opening that is disposed within said chamber space to discharge into said chamber space fluid that has entered said device through said inlet, and said baffle section comprises a surface which is concave in transverse cross section, which confronts said discharge opening, and which extends from its confrontation with said discharge opening lengthwise along an arc to said outlet to direct fluid toward said outlet.

10. The improvement set forth in claim 9 in which said inlet is disposed in an axial end wall portion of the wall of said chamber and said outlet is disposed in a sidewall portion of the wall of said chamber.

11. The improvement set forth in claim 9 in which said inlet comprises a circular transverse cross section, said outlet comprises a circular transverse cross section, and the axis of said outlet is disposed at an approximate right angle to the axis of said inlet.

12. The improvement set forth in claim 9 in which said inlet is disposed in an axial end wall portion of the wall of said chamber, said outlet is disposed in a sidewall portion of the wall of said chamber, said inlet comprises a circular transverse cross section, said outlet comprises a circular transverse cross section, and the axis of said outlet is disposed at an approximate right angle to the axis of said inlet.

13. The improvement set forth in claim 9 in which said surface axially overlaps a portion of said venturi section that is immediately contiguous said discharge opening.

14. The improvement set forth in claim 13 in which said discharge opening is circular and said surface as viewed in transverse cross section has an arcuate extent slightly less than that of a semi-circle as measured about said discharge opening.

15. The improvement set forth in claim 9 in which said baffle section further includes an integral tubular section which fits closely within and has a snap-on attachment with a tubular-walled opening extending through the wall of said chamber for disposing said baffle section on said chamber, said tubular section forming said outlet.

16. The improvement set forth in claim 9 in which said venturi section includes an integral tubular section which fits closely within and has a snap-on attachment with a tubular-walled opening extending through the wall of said chamber for disposing said venturi section on said chamber, said tubular section forming said inlet.

* * * * *